US011242686B2

(12) United States Patent
Jacobsen et al.

(10) Patent No.: US 11,242,686 B2
(45) Date of Patent: Feb. 8, 2022

(54) ROOF WINDOW SYSTEM WITH IMPROVED TRANSITION MEANS BETWEEN A ROOF WINDOW AND A VENTILATION ASSEMBLY

(71) Applicant: VKR Holding A/S, Hørsholm (DK)

(72) Inventors: Per Jacobsen, Horsens (DK); René Borup-Jensen, Århus (DK)

(73) Assignee: VKR Holding A/S

( * ) Notice: Subject to any disclaimer, the term of this patent is extended or adjusted under 35 U.S.C. 154(b) by 165 days.

(21) Appl. No.: 16/632,361

(22) PCT Filed: Jul. 20, 2018

(86) PCT No.: PCT/DK2018/050185
§ 371 (c)(1),
(2) Date: Jan. 19, 2020

(87) PCT Pub. No.: WO2019/015732
PCT Pub. Date: Jan. 24, 2019

(65) Prior Publication Data

US 2020/0224423 A1 Jul. 16, 2020

(30) Foreign Application Priority Data

Jul. 21, 2017 (DK) ..... PA 2017 70587

(51) Int. Cl.
*E04D 13/03* (2006.01)
*E04D 13/035* (2006.01)
(Continued)

(52) U.S. Cl.
CPC ..... *E04D 13/0354* (2013.01); *E04D 13/031* (2013.01); *E04D 13/0325* (2013.01);
(Continued)

(58) Field of Classification Search
CPC ... E04D 13/03; E04D 13/031; E04D 13/0325; E04D 13/0354; E04D 13/14; E05Y 2900/152; E06B 7/02; E06B 7/10
(Continued)

(56) References Cited

U.S. PATENT DOCUMENTS 7,624,547 B1 * 12/2009 Brinton ..... E04D 13/0305 52/198
7,647,735 B2 * 1/2010 Kristensen ..... E04D 13/031 52/200
(Continued)

FOREIGN PATENT DOCUMENTS

DE 20204020630 1/2006
DE 102004037563 3/2006
(Continued)

OTHER PUBLICATIONS

Written Opinion of the International Searching Authority for Application No. PCT/DK2018/050185 dated Oct. 12, 2018.
(Continued)

*Primary Examiner* — Brian E Glessner
*Assistant Examiner* — James J Buckle, Jr.
(74) *Attorney, Agent, or Firm* — Merek, Blackmon & Voorhees, LLC

(57) ABSTRACT

In a roof window system, the roof window (1) has a frame with a frame top member (21), and a sash with a sash top member (31), and further a ventilation device (40) for connection to a ventilation assembly by means of transition means provided between the ventilation assembly and the frame top member (21) and the sash top member (31) of the roof window (1) to accommodate a set of flow paths for air to and from the ventilation assembly. The transition means comprise a plurality of apertures (2102) extending through the frame top member (21).

20 Claims, 11 Drawing Sheets

(51) Int. Cl.
*E06B 7/10* (2006.01)
*F24F 13/18* (2006.01)

(52) U.S. Cl.
CPC ..... *E05Y 2900/152* (2013.01); *E06B 7/10* (2013.01); *F24F 13/18* (2013.01); *F24F 2221/20* (2013.01)

(58) Field of Classification Search
USPC ..... 52/200
See application file for complete search history.

(56) References Cited

U.S. PATENT DOCUMENTS

| | | | | |
|---|---|---|---|---|
| 2012/0167495 | A1* | 7/2012 | Lindgren | E04D 13/031 52/200 |
| 2014/0230349 | A1* | 8/2014 | Rasmussen | E06B 7/2314 52/200 |
| 2014/0366468 | A1* | 12/2014 | Lindgren | E06B 1/603 52/200 |
| 2018/0230733 | A1* | 8/2018 | Skyum | E06B 1/30 |
| 2021/0198893 | A1* | 7/2021 | Nielsen | E04D 13/0325 |

FOREIGN PATENT DOCUMENTS

| | | |
|---|---|---|
| DE | 202016100906 | 7/2016 |
| DK | 200001472 | 4/2019 |
| EP | 372597 | 6/1990 |
| EP | 0458725 | 11/1991 |
| EP | 1978176 | 10/2008 |
| EP | 2784240 | 10/2014 |
| EP | 2813632 | 12/2014 |
| EP | 2947217 | 11/2015 |
| WO | WO2008/133539 | 11/2008 |
| WO | WO2013050042 | 4/2013 |

OTHER PUBLICATIONS

PCT International Search Report on Patentability for PCT/DK2018/050185 dated Oct. 12, 2018.

English language translation of the First Office Action issued in corresponding Chinese Patent Application No. 2018800418185.X, eight (8) pages.

English language translation of the claims addressed in the First Office Action issued in corresponding Chinese Patent Application No. 2018800418185.X, five (5) pages.

English language translation of the Second Office Action issued in corresponding Chinese Patent Application No. 2018800418185.X, six (6) pages.

English language translation of the claims addressed in the /Second Office Action issued in corresponding Chinese Patent Application No. 2018800418185.X, five (5) pages.

Extended European Search Report dated Sep. 1, 2021 issued in corresponding European Patent Application No. 21179116.5, fourteen (14) pages.

* cited by examiner

ROOF WINDOW SYSTEM WITH IMPROVED TRANSITION MEANS BETWEEN A ROOF WINDOW AND A VENTILATION ASSEMBLY

TECHNICAL FIELD

The present invention relates to a roof window system comprising a roof window having a frame including a frame top member, two side members and a bottom member, defining a frame plane, and a sash including a sash top member, sash side members and a bottom member, and a pane, the roof window further comprising a ventilation device adapted for providing ventilation of a building in which the roof window is mounted, a ventilation assembly including a housing accommodating at least one ventilation unit connected to an aperture for air intake and exhaust, transition means being provided between the ventilation assembly and the frame top member and the sash top member of the roof window to accommodate a set of flow paths for air to and from the ventilation assembly.

BACKGROUND ART

In recent years, the interest in energy-balanced buildings has increased and several attempts have been made to provide houses in which the energy for heating, cooling, water for domestic use etc. is provided solely by the surroundings.

One area of focus is the windows of the building, since one of the primary functions in a window, besides admitting light, is to allow stale, warm, or otherwise used or spent air inside the building (so-called "room air") to exit and allowing fresh air from the exterior ("outdoor air") to enter the building in which the window is installed. This presupposes that the window is openable. Over time, the provision of ventilation in windows, also in situations in which the window is not open, either because it is a fixed window, or simply is not open, has become more or less standard equipment. This is the result of, among other things, increased focus on improving indoor climatic conditions and the microclimate in buildings. One example of a roof window providing a ventilating aperture is the well-known VELUX® with a ventilation flap, which in pivot-hung windows also fulfils the double function of operating the window.

Natural ventilation provided by such a ventilation device has a number of advantages. Among others, it is free of charge and noise-less. However, in certain fields of applications, for instance mechanical ventilation may be desirable. Examples of prior art roof window systems, including roof windows and ventilation assemblies, are shown in for instance Applicant's European patents EP0458725B1 and EP0372597B1, and in published Danish patent application DK200001472A. Other examples are shown in documents DE102004037563A1, 20204020630U1, DE19811469A1 and DE2906729U1.

Although many of the above-mentioned prior art roof window systems, roof windows and ventilation assemblies provide well-functioning solutions, they also require that the roof window is built to receive such a ventilation assembly, typically by designing special parts and/or requiring further investment in the installation of auxiliary parts and installation equipment. Thus, severe limitations as to retro-fitting existing windows exist.

One recent development of such roof window systems is described in Applicant's European patent application published under EP 2 784 240 A2. Here, the ventilation assembly takes in outdoor air via ventilation units having flow channels connected to the ventilation device of the roof window and, conversely, allows room air to be led to the exterior in the form of exhaust air through the ventilation assembly. In one embodiment, the ventilation units comprise a ventilator and a heat exchange device in the form of a regenerator. The counterpart commercial product has proven to work well, and the roof window system alleviates the disadvantages of the earlier prior art to a great extent. One document devising further improvements of the above EP application is found in DE utility model 20 2016 100 906 U1.

Although both of these documents devise well-functioning roof window systems, there is an ongoing aspiration to improve the product itself, with an ever-increasing focus on improving the ventilation properties. Furthermore, challenges as to retrofitting still exist, since the construction of the relevant parts of the roof window depends on the functionality. For instance, a top-hung roof window has a more complex configuration at the top, i.e. at the typical connection point for the ventilation assembly. Similarly, an electrically operated roof window requires space for accommodation of operating equipment at the typical interfaces with the ventilation assembly.

SUMMARY OF INVENTION

With this background, it is therefore an object of the present invention to provide a roof window system, which provides for an improved connection between the roof window and the ventilation assembly, irrespective of the functionality of the roof window, and which at the same time provides for increased insulation and overall improved environmental conditions.

This and further objects are achieved with a roof window system of the kind mentioned in the introduction, in which said transition means comprise a plurality of apertures extending through the frame top member Thereby a roof window system is provided in which the transition between the two components of the roof window system, i.e. the roof window and the ventilation assembly, is carried out at a position which is as neutral as possible, that is, rather than leading the flow paths above the top frame member as in the prior art, the frame may accommodate other equipment as well, for instance a top hinge device. Furthermore, guiding the air through the frame top member also entails improved insulation properties, as the flow paths will extend through an area with better insulation.

In one presently preferred embodiment, the plurality of apertures extending through the frame top member are located mainly in the bottom half part of the height of the frame top member, more preferably in the lower third part of the height of the frame top member.

Further presently preferred embodiments and further advantages will be apparent from the following detailed description and the appended dependent claims.

BRIEF DESCRIPTION OF DRAWINGS

The invention will be described in more detail below by means of a non-limiting example of an embodiment and with reference to the schematic drawing, in which.

DESCRIPTION OF EMBODIMENTS

Figure 1:
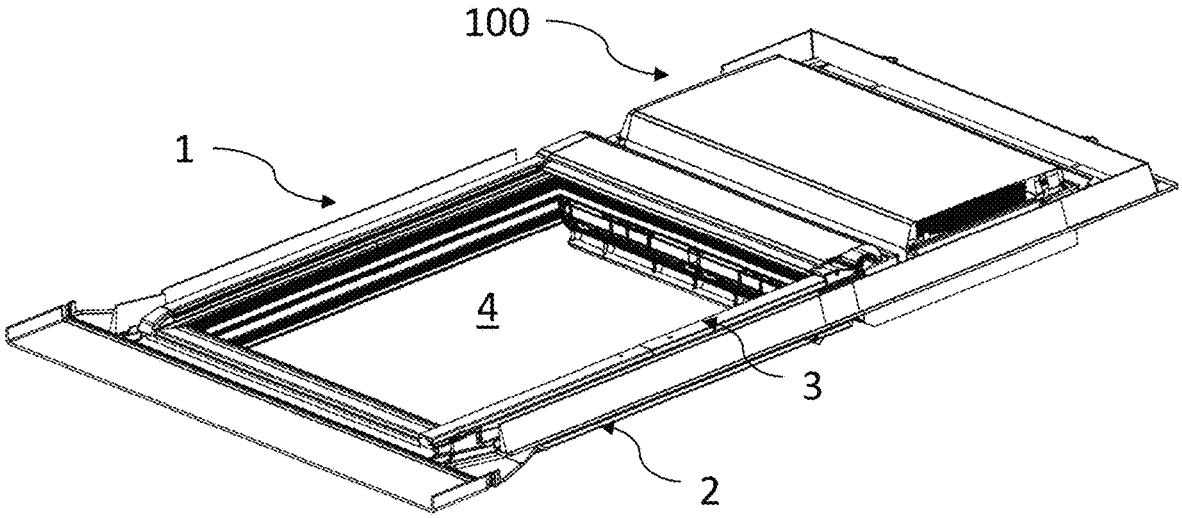
FIG. 1 shows a perspective view of a roof window system in an embodiment of the invention.

Referring first to FIG. 1 showing the overall appearance and principles underlying a roof window system in an embodiment of the invention, the roof window system comprises a roof window 1 and a ventilation assembly generally designated 100.

The roof window 1 comprises at least one frame, in the embodiment shown and described two frames, of which one frame 2 is a stationary frame and an openable sash 3 encasing a pane 4. Details of the frame 2 and sash 3 are shown in more detail in FIGS. 13, 14 and 19. The frame 2 is, in a manner known per se, substantially rectangular and has a top member 21, and further a bottom member 22, and two side members, not shown in detail. The sash 3 has a top member 31 and two side members and further a bottom member, not shown in detail.

Figure 2:
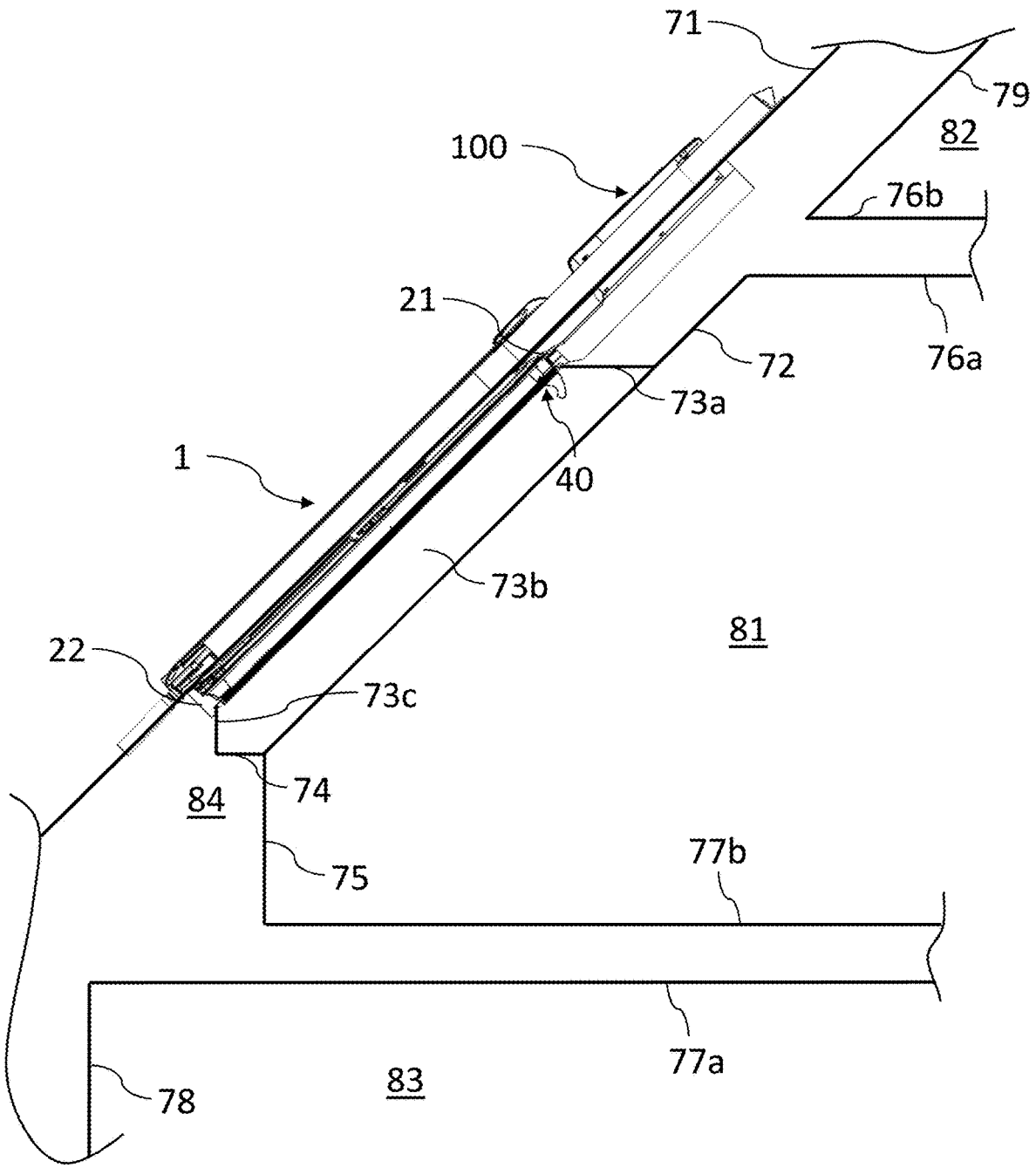
FIG. 2 shows the roof window system of FIG. 1 mounted in a roof structure.

The frame 2 is adapted to be built into a roof structure of virtually any kind, typically comprising a number of rafters and battens, and further non-shown details such as vapour barrier collars etc., below a roofing material constituting a roofing 71 as shown in FIG. 2.

Referring now further to FIG. 2, an embodiment of the roof window system is shown installed in an upstairs room 81 of a multi-storey building. Above the room 81, an attic 82 is present; however, this could also be a further inhabited storey, or a loft. Below the room 81, a downstairs room 83 is present. In a typical situation, the downstairs storey is the first, or ground, floor of a house, the room 81 located upstairs being thus located on the second floor of the house.

As shown, the frame 2 is built into the roof structure such that the frame plane is substantially parallel to roofing 71. The transition to the room 81 in the upstairs storey is here provided in that a set of lining panels comprising a top lining panel 73*a*, two side lining panels of which one side lining panel 73*b* is shown, and a bottom lining panel 73*c*, adjoins an inclined inner wall 72 of the upstairs room 81. At the frame bottom member 22, the bottom lining panel 73*c* is here shown connected to a window sill 74 and further to a knee wall 75 closest to a floor 77*b* of the upstairs storey, i.e. typically the second floor of a house. Alternatively, a different bottom lining panel could extend directly from the frame 2 to the floor 77*b*.

Opposite the floor 77*b*, the upstairs room 81 has a ceiling 76*a* which in turn adjoins the storey partition to the attic 82, here shown with a floor 76*b* and an inner wall 79.

The floor 77*b* of the upstairs room adjoins the storey partition to the downstairs storey and hence to downstairs room 83, having a ceiling 77*a* and an inner wall 78 which is typically vertical.

Finally, a roof void 84 is shown formed behind the knee wall 75. The roof void 84 typically unused space, but may be utilised for piping, wiring and additional insulation, and alternatively or additionally also for storage.

In the embodiment shown, the roof window 1 is centre-hung in that the sash 3 is connected to the frame 2 by a pivot hinge (not shown) provided between side members of the frame 2 and sash 3, respectively, to be openable by tilting the sash 3 of the window 1 about a pivot hinge axis defined by the pivot hinge. As used in this description, a closed position of the roof window 1 means a position in which the frame plane and the sash plane coincide, that is form an angle of 0 degrees with each other. Similarly, an open position of the roof window 1 as used herein generally means a position in which the sash 3 is tilted about the pivot hinge axis such that the frame plane and the sash plane no longer coincide. Notwithstanding the centre-hung roof window described, the window according to the invention may in other embodiments be top-hung, with or without an intermediate frame structure, have the hinge axis somewhere between the top and the centre, be side-hung or for that matter even be bottom-hung, or fixed, i.e. not openable. As will be described in further detail below, the roof window system also provides for optional ventilation in the closed position of the window. Furthermore, the window may be electrically operated, or prepared for retrofitting of an electrical operator. Finally, the roof window system comprises a screening arrangement 5 in the form of a roller shutter, in the embodiment shown.

The sash 3 and frame 2 of the window according to the invention may be made of wooden members or members made of cast or extruded polyurethane (PUR). In the installed position, the frame 2 and sash 3 are protected, in a manner known per se, by an assembly of cover elements generally designated 6 and including a cladding and a flashing arrangement. Towards the interior, a suitable finishing may be provided, for instance comprising a lining panel. In the embodiment shown, the interior side of the sash members are substantially flush with the interior side of the frame members.

Furthermore, the frame bottom member 22 may be provided with an over-height, that is, taller than is necessary in order to surround the sash 3, which in turn makes it possible to utilise standard flashing members at the bottom, even if the roof window 1 is installed at a deep position in the roof structure.

The roof window 1 of the invention forms part of a roof window system, which in addition to the roof window 1 comprises a ventilation assembly generally designated 100. In the embodiment shown, the ventilation assembly 100 is positioned above the top member of the window frame 2 as seen in the inclination of the roof.

In the roof window system in the embodiment of FIG. 2, the roof window 1 is installed to provide light and ventilation in the room 81 located upstairs in the multi-storey building, namely a room adjacent or at least in proximity to the inclined roof. As will be described in further detail below, the ventilation assembly 100 at the frame top member 21 is in fluid connection with a ventilation device of the roof window 1, here generally designated 40.

Figure 14:
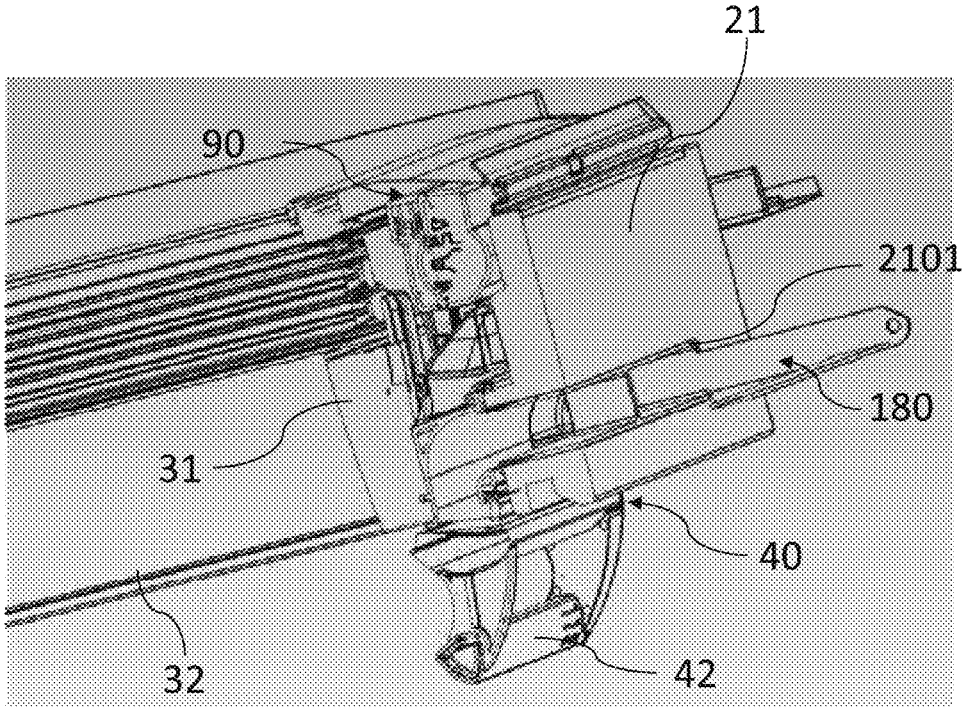
FIG. 14 is a partial perspective sectional view of the roof window of FIG. 5.
Figure 19:
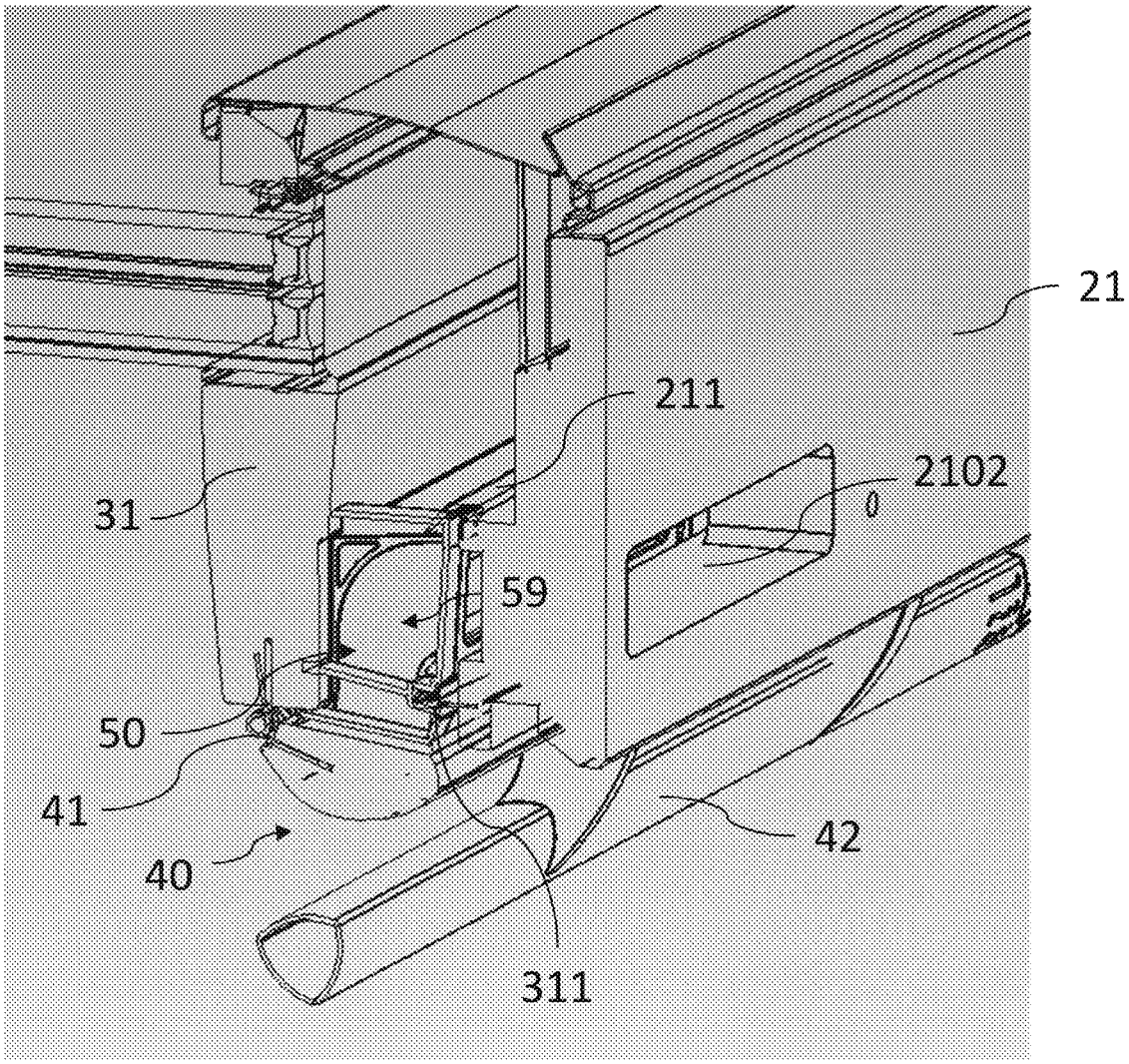
FIG. 19 is a partial perspective sectional view of the roof window of FIG. 5.
Figure 20:
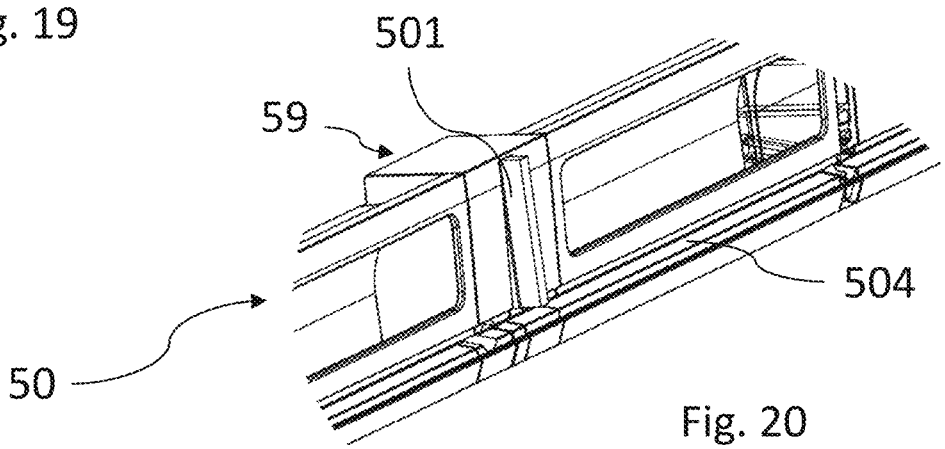
FIG. 20 is an enlarged fraction showing details of the roof window in an embodiment of the roof window system according to the invention.

Referring now also to FIGS. 14 and 19, the ventilation device in the embodiment shown comprises a ventilation flap 40, which is connected to the top member 31 of the sash 3 via a hinge connection 41 and which furthermore comprises a handle 42.

Operating the handle 42 rotates the ventilation flap 40 from an open position to a closed position and vice versa. One or more intermediate positions, in which the ventilation flap 40 may be temporarily locked, may be defined between the open and closed position. In the embodiment shown and described, the sash 3 is pivotally connected to the frame 2, and the ventilation flap 40 is adapted to assume three position, viz. a first or closed position, in which the roof window 1 is closed and no ventilation is provided, a second and ventilating position, in which the roof window 1 is still closed but a ventilation aperture is provided to allow air passage, and a third and entirely open position, in which the sash 3 is able to pivot relative to the frame 2 to open the window. In other windows, for instance a top-hung roof window, the ventilation flap 40 may be able to assume only two position, viz. a closed position and an open, ventilating position, whereas operation of the sash takes place in other ways, for instance by a handle or other operating means located at the bottom member of the sash.

Details of one embodiment of the ventilation assembly 100 will now be described in further detail with reference to in particular FIGS. 6 to 10. For the general operating principles underlying the ventilation assembly, reference is made to the above-mentioned EP 2 784 240 A1. The reference includes also ventilation units with ventilators and regenerators accommodated in the ventilation assembly.

The ventilation assembly 100 comprises a housing 150 and a cover 151. The cover 151 has two apertures 152 for air intake and exhaust, the apertures 152 being provided at mutually opposite sides of the cover 151.

Transition means provided between the ventilation assembly 100 and the top frame member 21 and the sash top member 31 of the roof window 1 according to the invention will now be described in some detail. As in the prior art, these transition means are configured to accommodate a set of flow paths to and from the ventilation assembly 100.

In the embodiment shown, the housing 150 of the ventilation assembly 100 is composed of three main components, namely in the form of a plurality of sections including a bottom section 161, an intermediate section 162 and a top section 163. Each of these sections is made of an insulating material. The material is preferably easy to manufacture and handle during assembly. It is also advantageous that the material is light-weight. In any event, the material should be able to withstand compressional and tensional forces to a certain extent and furthermore be able to provide the tightness required in such a ventilation assembly. One example is expanded polypropylene (EPP).

Figure 7:
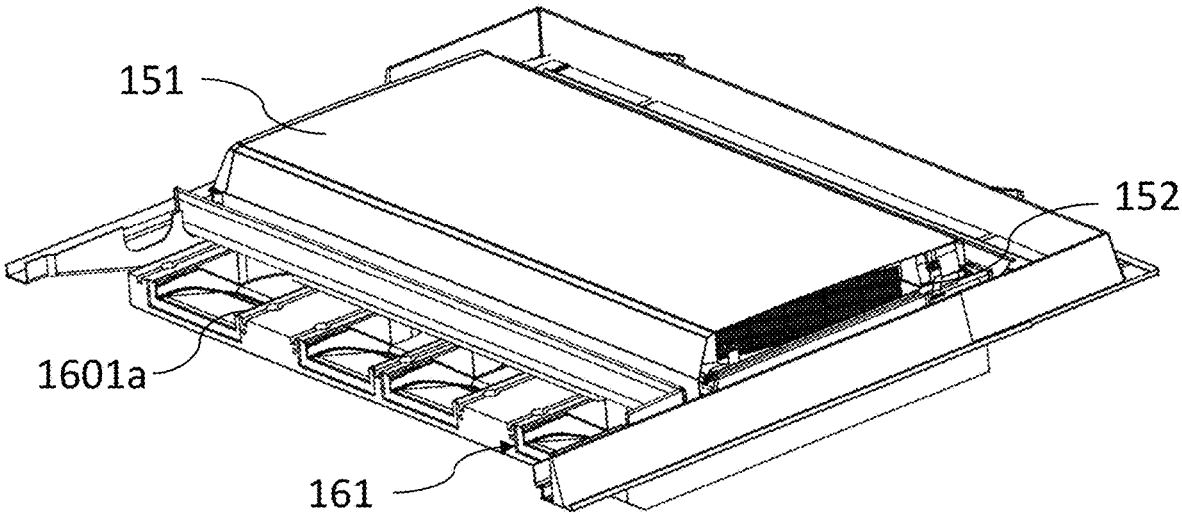
Figure 8:
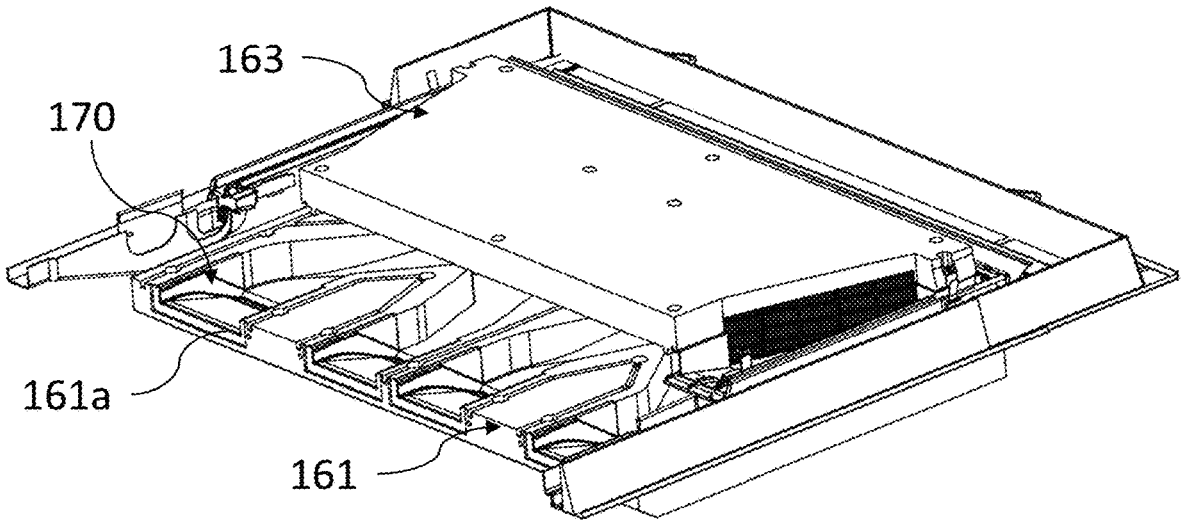
Figure 9:
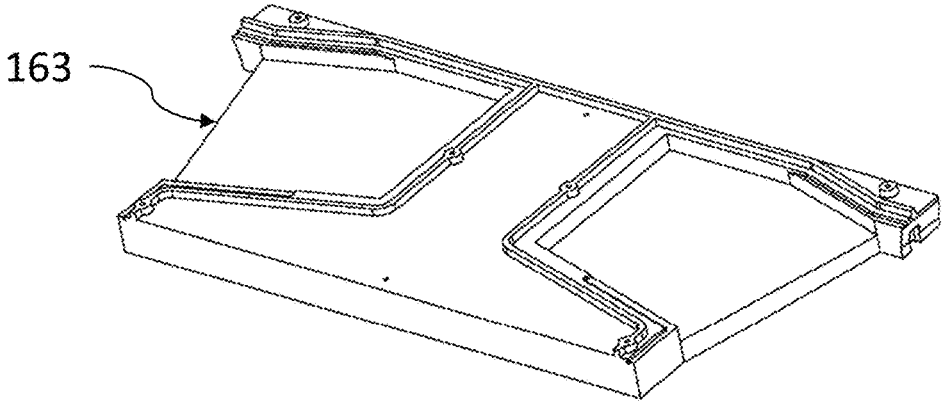

The top section 163 functions as a cover to the bottom section 161, and is configured to accommodate internal parts of the ventilation units, cf. FIGS. 7 and 8. As is apparent, the bottom section 161 has a depth which exceeds that of the roof window 1, i.e. the bottom section 161 is located deep in the roof structure which is advantageous from an insulation point of view.

Figure 10:
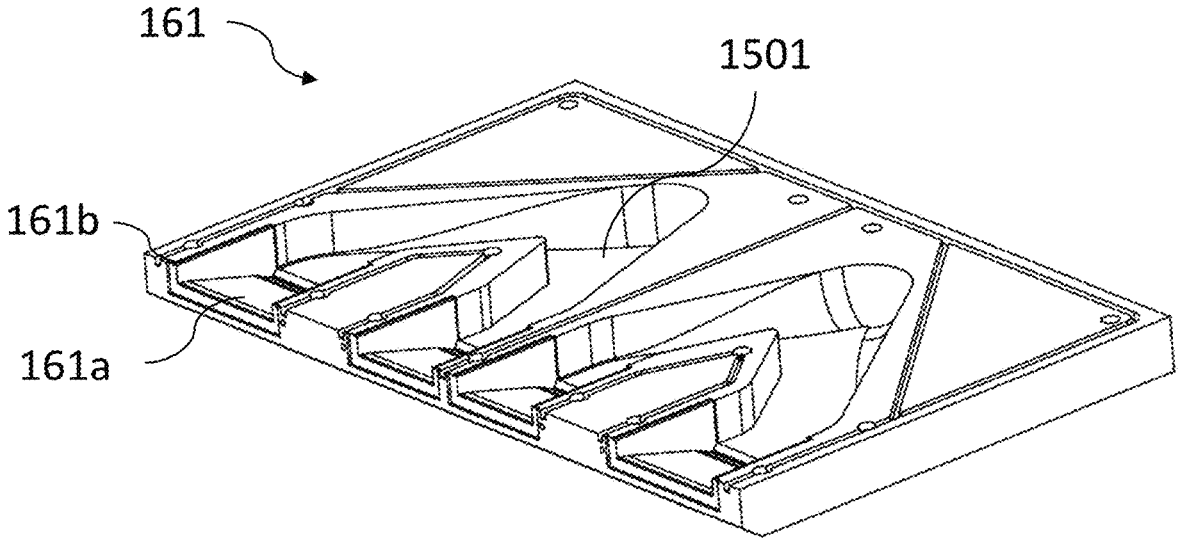

The bottom section 161 is provided with a number of recesses or depressed portions, of which flow channel 1501 is shown in FIG. 10 to represent the set of flow channels present in the housing 150 of the ventilation assembly 100 to form a fluid connection with the flow paths through the transition means.

At the front, or left-hand end of FIGS. 5 to 9, the bottom section 161 has an entrance portion 161*a*, which together with the underside of the intermediate section 162 forms an opening constituting a transition channel 1601 to the roof window 1. As shown, there are three other entrance portions corresponding to entrance portion 161*a*, which in turn provides for four transition channels 1601, 1602, 1603, 1604. All of these transition channels thus form part of the transition means between the ventilation assembly 100 and the roof window 1 and are here formed integrally in the housing 150 of the ventilation assembly 100.

Figure 12:
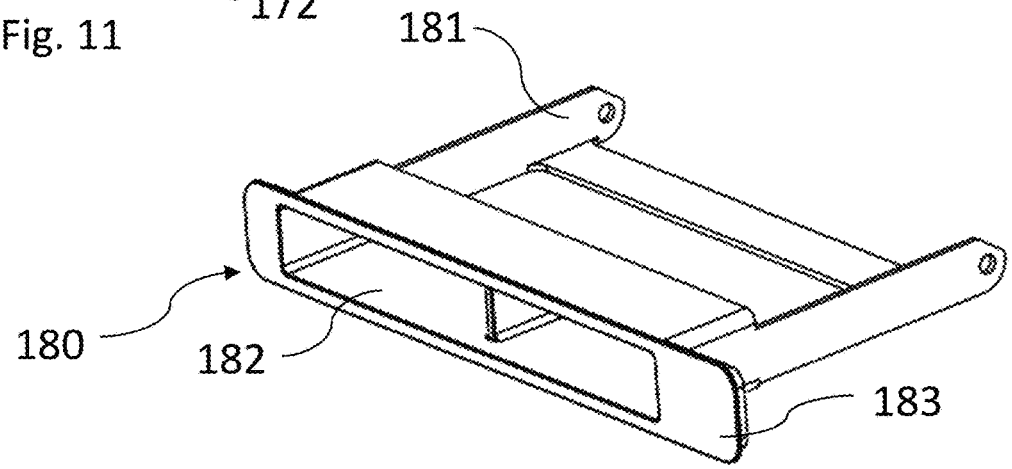
FIG. 12 shows a detail of the roof window shown in FIG. 5, on a larger scale.

In the mounted condition, the transition channels 1601, 1602, 1603, 1604 are in direct connection with apertures 2101, 2102, 2103, 2104 in the frame top member 21 (cf. FIG. 12). The bottom section 161 and the intermediate section 162 abut directly on the outer side of the frame top member 21 such that a substantially tight transition is achieved for the air flowing between the room in which the roof window is mounted and the ventilation assembly and vice versa.

Figure 11:
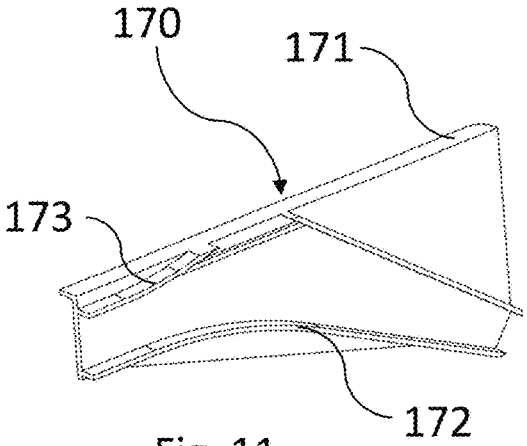
FIG. 11 shows a detail of the ventilation assembly shown in FIG. 8, on a larger scale.
Figure 13:
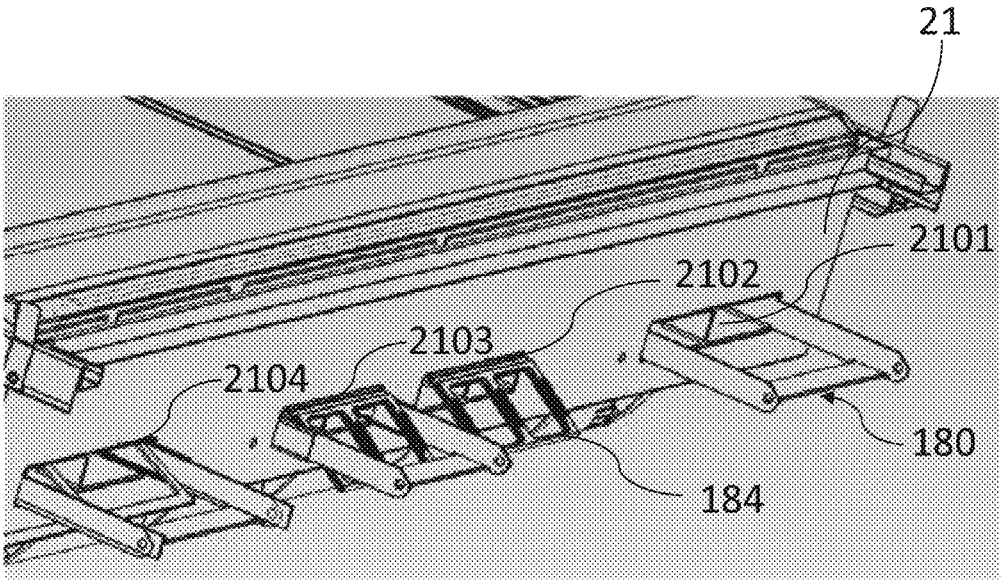
FIG. 13 shows a partial perspective view of the roof window of FIG. 5.
Figure 15:
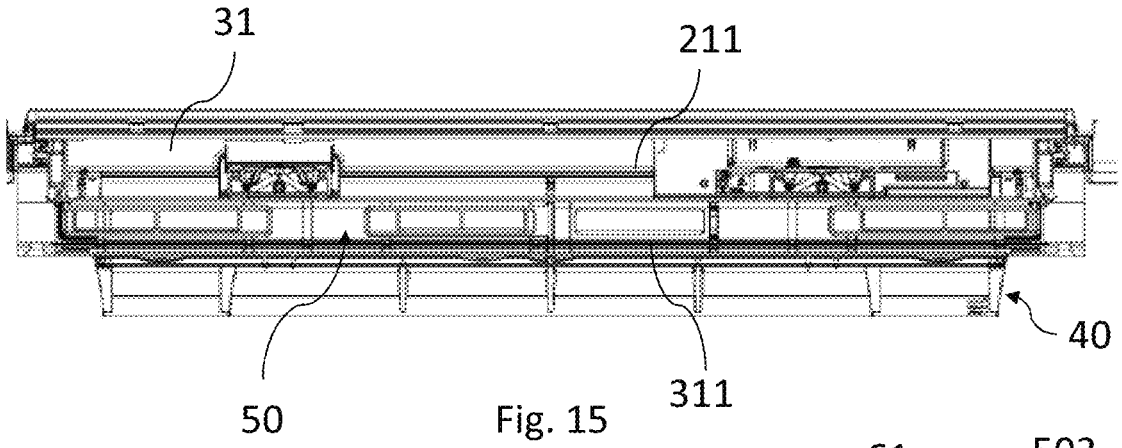
FIG. 15 is a sectional view of the roof window.

Referring now also to FIGS. 13 to 15, with particular reference to FIGS. 10 to 12, another feature of the invention will be described, which feature enhances the climate provided by the roof window system even further. Here, the transition means comprise a filter assembly as follows: A filter rail 170 is accommodated in the entrance portion 161*a* in the bottom section 161 of the housing 150. The filter rail 170 is preferably releasably connected to the housing 150. In the embodiment shown, the releasable connection is carried out in that a flange 171 on the filter rail 170 rests on shoulder portion 161*b* of bottom section 161. The filter rail 170 is provided with lower guide 172 and upper guide 173, which form a track to receive a filter holder 180 by a leg 181 thereof. The filter holder 182 has an opening 182 through which air flows and a surrounding flange 183 to abut on a ventilation rack 50 accommodated in the top sash member 31 as will be described in the following, and furthermore accommodates a filter element 184. The filter holder 180 and the remaining three filter holders, which may be identical to the filter holder 180, are received in the apertures 2101-2104 of the frame top member 21. For reasons of clearness in the reading of the drawings, the filter holder 180 located in the aperture 2101 is shown without a filter element, whereas the filter element 184 shown in aperture 2102 is shown without its filter holder. The provision of a filter assembly contributes to an improved interior climate in the building. The filter elements may easily be cleaned or exchanged on a regular basis in order to maintain the indoor climate at a high level.

Figure 5:
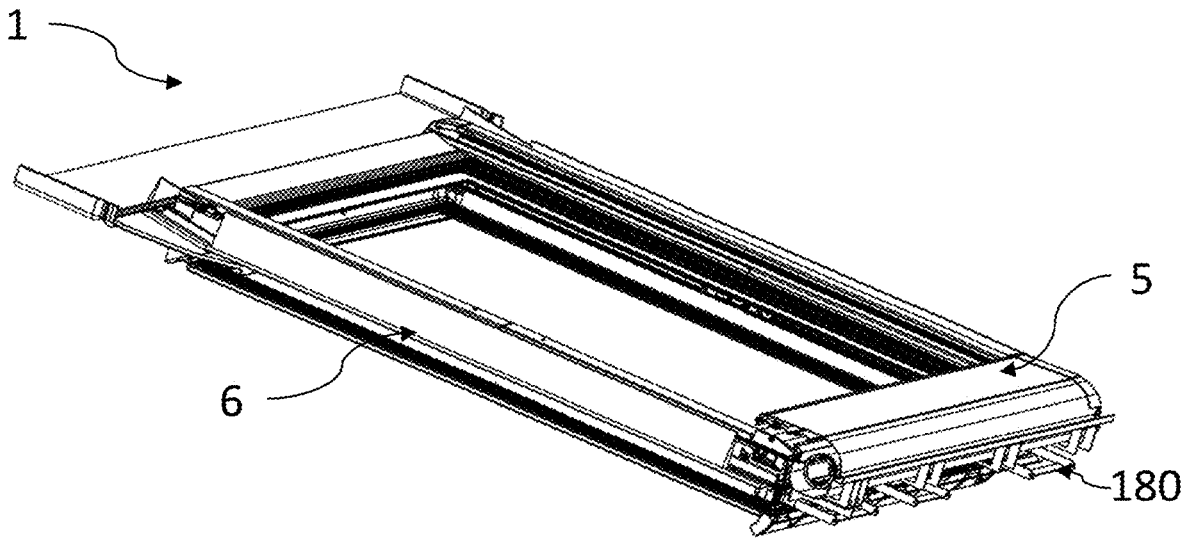
FIG. 5 shows a perspective view of the roof window of the roof window system of FIG. 4, the ventilation assembly being removed.
Figure 6:
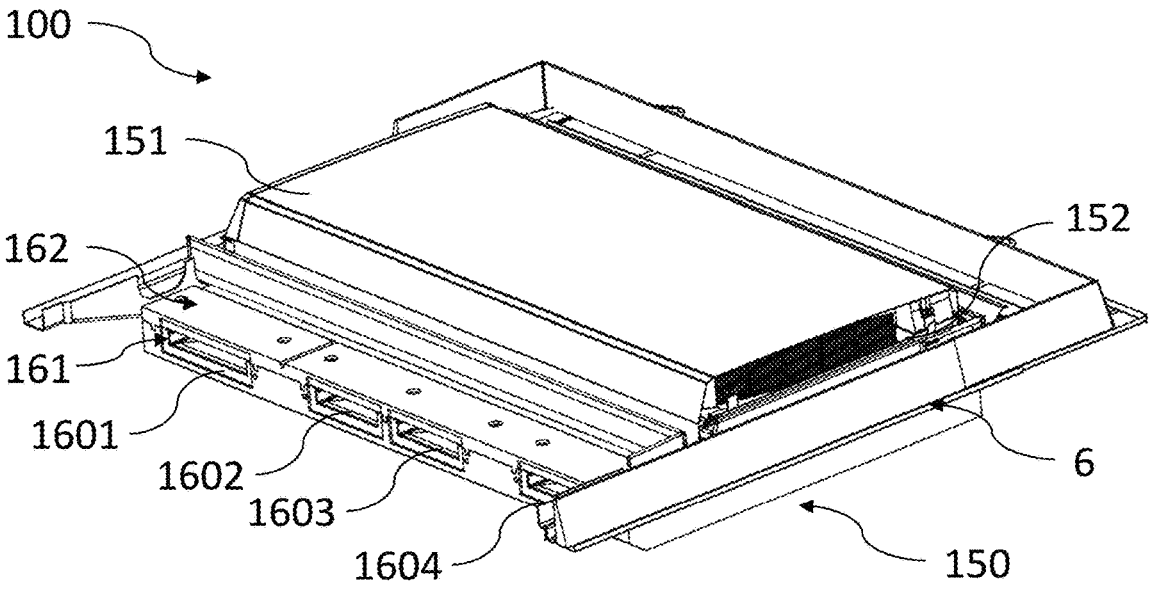
FIGS. 6 to 10 show perspective views of details of the ventilation assembly of the roof window system shown in FIG. 4.

A central feature of the invention emanates from in particular FIGS. 13 and 14, namely that the transition means between the roof window 1 and the ventilation assembly 100, in the embodiment shown represented by filter holder 180 accommodated in aperture 2101, are located in the bottom part of the frame top member 21. Preferably, the apertures 2101, 2102, 2103, 2104 extending through the frame top member 21 are located mainly in the bottom half part of the height of the frame top member 21, more preferably in the lower third part of the height of the frame top member 21. Additionally, or alternatively, the apertures in the frame top member are located below, in the height direction of the frame top member 21, internal equipment located at the top of the roof window, such internal equipment selected from the list comprising at least one of: a top hinge device, electrical operator means, a covering assembly, and a screening arrangement. Such internal equipment is generally designated 90 in FIG. 14; the screening arrangement 5 is shown in FIG. 5 but has been removed from the detailed view of FIG. 14 for ease of readability. The relative positioning of the internal equipment, which does not require insulation, on one hand, and the apertures through which air will be transferred, entails an improved overall energy performance of the roof window system.

Figure 16:
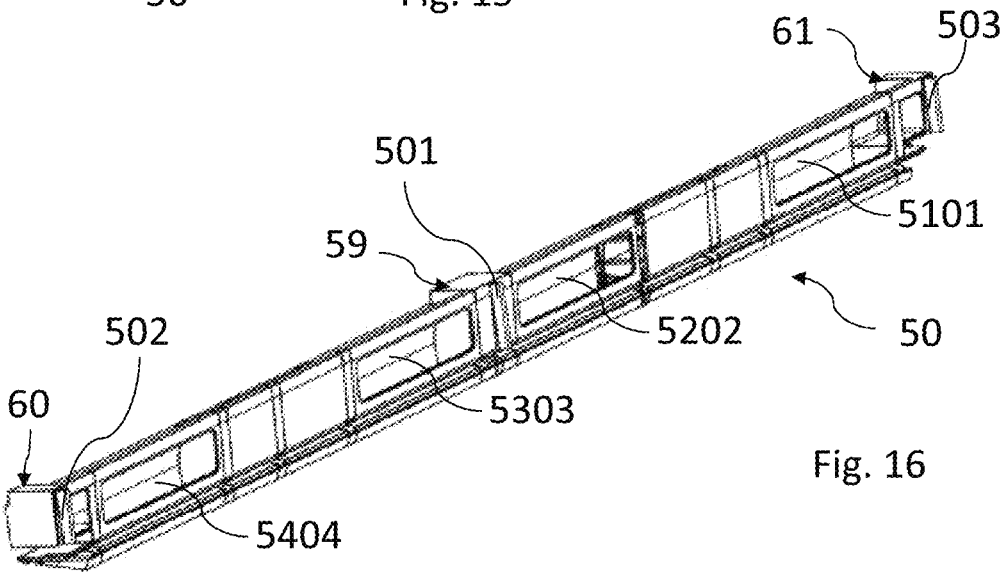
FIG. 16 shows a perspective view of a detail of the roof window embodiment shown in FIG. 15.
Figure 17:
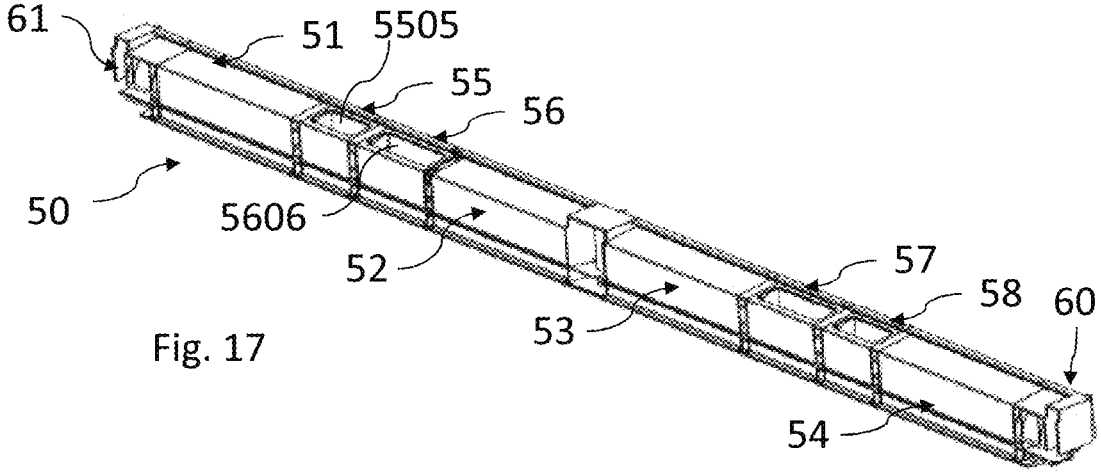
FIG. 17 shows a perspective view of the detail of FIG. 16, from another angle.
Figure 18:
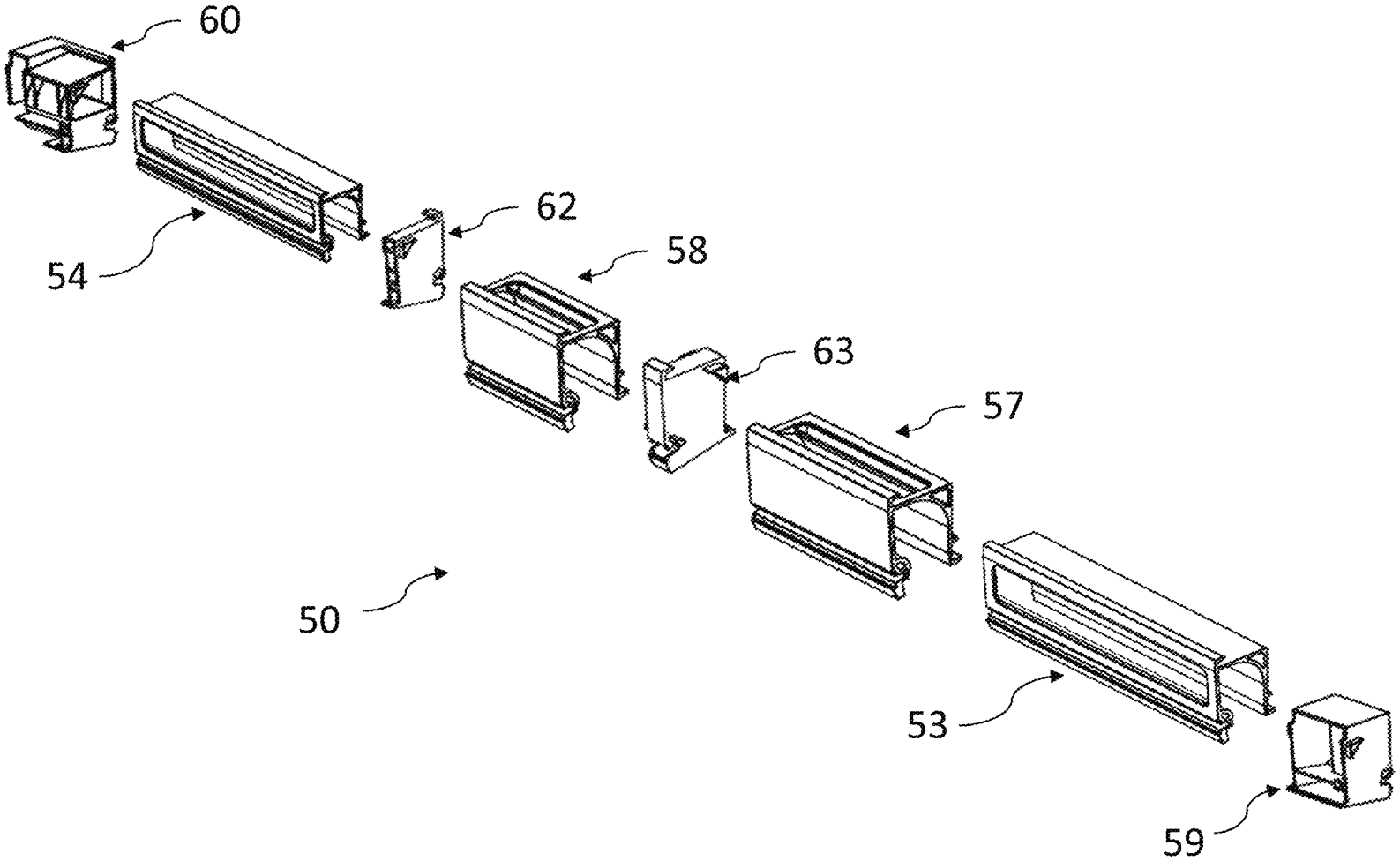
FIG. 18 is an exploded perspective view of the detail shown in FIGS. 16 and 17.

With reference to FIGS. 16 to 18, a further aspect of the present invention will be described in detail. Here, it is shown how the ventilation rack generally designated 50 comprises a plurality of rack sections. Four rack sections are dedicated to ventilation, i.e. to provide a flow path for air to and from the ventilation assembly 100. This applies to a first rack section 51 with aperture 5101, second rack section 52 with aperture 5202, third rack section 53 with aperture 5303 and fourth rack section 54 with aperture 5404. In the embodiment shown, there are two rack sections dedicated to ventilation on either side to correspond with, i.e. form a fluid connection with, apertures 2101, 2102, 2103, 2104 in the frame top member 21. Furthermore, said plurality of rack sections here comprise a fifth rack section 55 with an aperture 5505 configured to receive locking means (not shown) and a sixth rack section 56 with an aperture 5606 configured to accommodate operating means of an electrical operator. Seventh and eighth rack sections 57 and 58 correspond to sixth and fifth rack sections 56 and 55, respectively. In the embodiment shown, the rack sections 51-58 are positioned symmetrically about a central rack section 59, but other configurations are conceivable. At the ends of the ventilation rack 50, an end rack piece 60, 61 is provided. In the exploded view of FIG. 18 one half of the ventilation rack 50 of FIGS. 16 and 17 is shown, including two rack bridge pieces 62 and 63. By the modular configuration of the ventilation rack 50 described in the above, a few standardised rack sections may be combined to fit any window size and functionality. In turn, this means that a more efficient employment of resources is obtained. In order to prepare the roof window 1 of the roof window system to retrofitting of accessories such as for instance an electrical operator or a screening arrangement, the set of standardised rack sections may also include sections with blind or knock-out plates to be removed in order to accommodate equipment of such accessories. The ventilation rack 50, and in the embodiment shown, the rack sections, may be manufactured in any suitable way and from any suitable material, for instance moulding of a plastic material.

Moreover, a further and presently preferred aspect of the invention will be described with particular reference to FIGS. 15 to 20. In a manner known per se the frame top member 21 is provided with a frame gasket 211 (frame top member 21 removed in FIG. 15, frame gasket 211 thus shown in a "loose" connection). Together with other sealing elements along the side and bottom of the roof window 1, this frame gasket 211 forms a first, or exterior, sealing plane. Towards the interior, a sash gasket 311, correspondingly with other sealing elements, forms a second, or interior, sealing plane. In the embodiment shown, the sash gasket 311 is received in a track 504 in the ventilation rack 50. To this end, the respective rack sections are provided with track portions (not shown in detail) to form the coherent, through track 504. A plurality of brush seals 501, 502, 503 are connected to the central rack section 59 and the end rack pieces 62, 63, respectively. Together with the frame gasket 211 and the sash gasket 311, the brush seals 501, 502, 503 form one or more closed chambers at the intersection between the frame 2 and the sash 3, here two closed chambers on either side of the central rack section 59. As a consequence, two flow channels between the roof window 1 and the ventilation assembly 100 pass in each of these closed chambers. The presence of such closed chambers are advantageous from a flow and insulation point of view, which in turn contributes to the improved environmental conditions.

Figure 3:
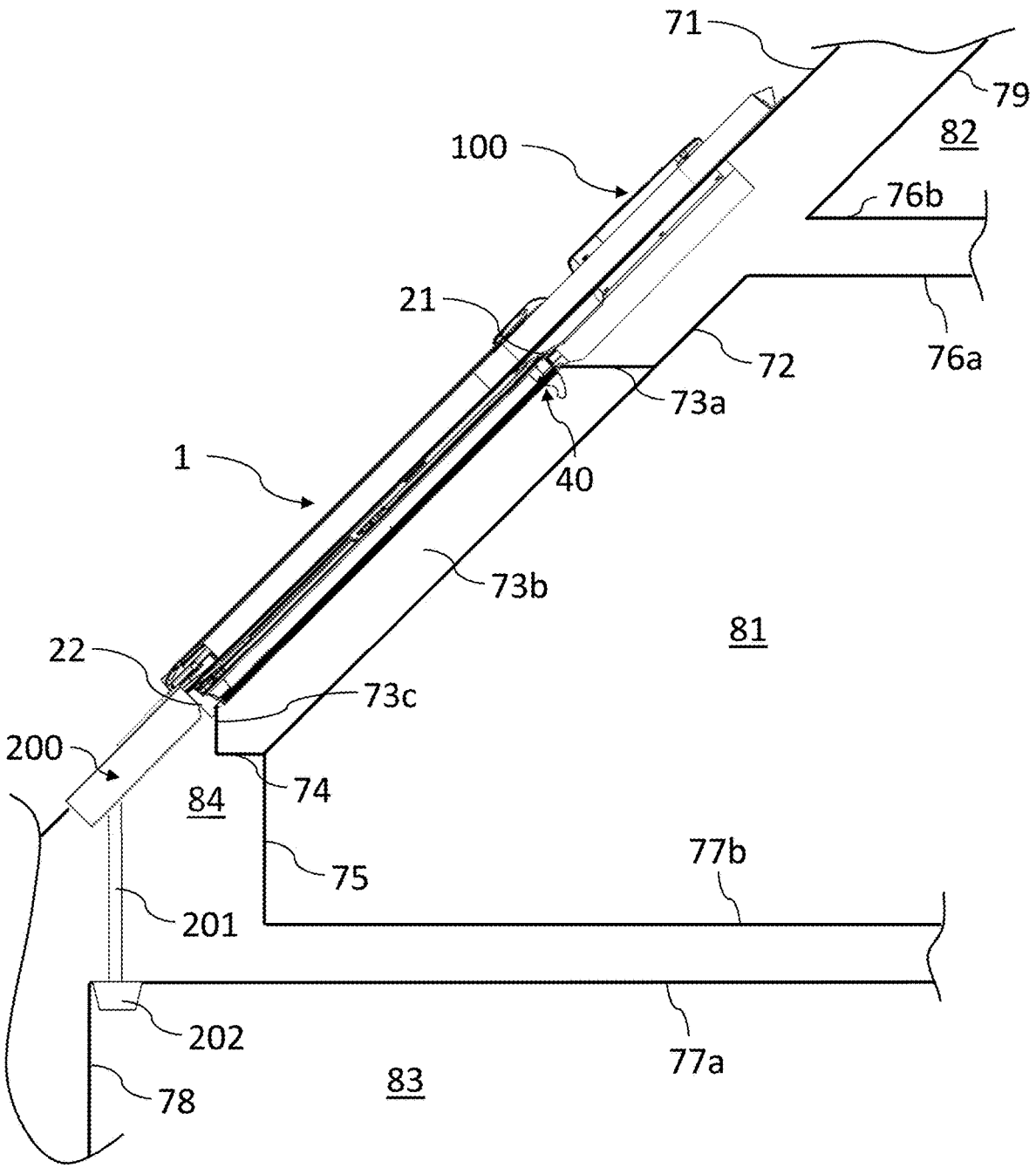
FIG. 3 is a view corresponding to FIG. 2 of a roof window system in an alternative embodiment of the invention.
Figure 4:
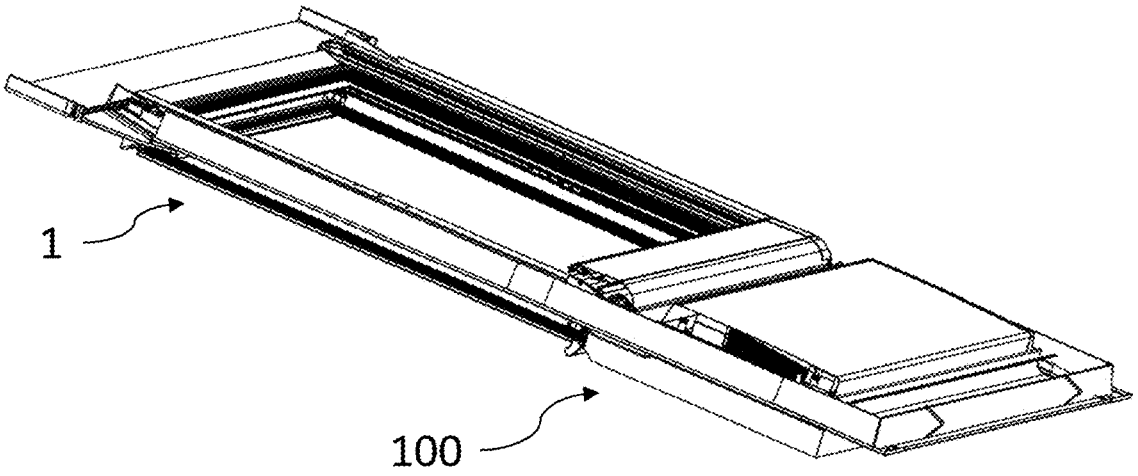
FIG. 4 shows a perspective view of the roof window system of FIGS. 1 and 2, seen from another angle.

Finally, and referring now to FIG. 3, a further embodiment of the roof window system according to the invention will be described.

As in the embodiments described in the above, the roof window 1 is connected to the ventilation assembly 100 at the top member 21 of the window frame 2. The ventilation assembly 100, in the following referred to as first ventilation assembly 100, will provide ventilation to the upstairs room 81 as described. An additional, second ventilation assembly 200 is in this embodiment provided at the frame bottom member 22. The second ventilation assembly 200 is in fluid connection with the downstairs room 83 by means of a duct 201 and a second ventilation device, here in the form of ceiling ventilation device 202 mounted in the ceiling 77*a* of the downstairs room 83. As shown, the second ventilation assembly 200 and the duct 201 are accommodated in the roof void 84. Although the duct 201 is here shown as a vertical element extending directly to the ceiling ventilation device 202 in the downstairs room 83 immediately below the upstairs room 81, it is conceivable to provide additional ducting distributing air to and from other downstairs rooms, either on the same floor or in other storeys of the building.

The second ventilation assembly 200 is preferably provided in fluid connection with the first ventilation assembly 100. The fluid connection is not shown in detail, but may for instance be provided in the form of ducts located along the side members of frame 2 as will be apparent to the person skilled in the art. In this way, the first ventilation assembly 100 provides for the air intake and exhaust, and possibly regeneration as described in the above, and the second ventilation assembly 200 may then be of a simpler design, providing only transfer of fresh air from the exterior to the downstairs room 83 and of stale air from the room 83 to the exterior via the first ventilation assembly. Alternatively, or additionally, the second ventilation assembly 200 is connected directly to the exterior, and not necessarily to the first ventilation assembly 100. Intake of fresh air from the outdoors may for instance be provided in the form of apertures in the cladding and covering elements allowing entry and exit of air, but not precipitation, and the second ventilation assembly 200 is then preferably self-contained in that one or more ventilation units are provided within the second ventilation assembly 200 to enable mechanical ventilation.

By connecting the second ventilation assembly 200 to the downstairs room 83, it is possible to utilise the aperture in the roof surface, which is traditionally only covered by the roof window 1, as a gateway to mechanical ventilation of rooms on the ground floor (or lower floors), in addition to the room that the roof window 1 is located in.

Furthermore, the roof window system including a first ventilation assembly 100 and a second ventilation assembly may be used as a simple, decentralised system to transfer heat from a room or rooms on one storey of a building to another. In addition to providing air exchange as described in the above, one example could be that heated air accumulating under the ceiling 77*a* of the downstairs room 73, resulting from a stove, fireplace or another heat source, could be used for transferring the heated air via the second ventilation device 202 to the ventilation device 40 of the roof window 1, thereby heating the second floor room 81.

It should be noted that the above description of preferred embodiments serves only as an example, and that a person skilled in the art will know that numerous variations are possible without deviating from the scope of the claims.

LIST OF REFERENCE NUMERALS

1 roof window
2 stationary frame
21 frame top member
211 frame gasket
2101 aperture
2102 aperture
2103 aperture
2104 aperture
22 frame bottom member
3 sash
31 sash top member
311 sash gasket
32 sash side member
4 pane
5 screening arrangement
6 assembly of cladding and covering elements
40 ventilation flap
41 hinge connection
42 handle
50 ventilation rack
501 first brush seal
502 second brush seal
503 third brush seal
504 track
51 first rack section (ventilation)
5101 aperture in rack section
52 second rack section (ventilation)
5202 aperture in rack section
53 third rack section (ventilation)
5303 aperture in rack section
54 fourth rack section (ventilation)
5404 aperture in rack section
55 fifth rack section (lock)
5505 aperture in rack section
56 sixth rack section (electrical operator)
5606 aperture in rack section
57 seventh rack section (electrical operator)
58 eight rack section (lock)
59 central rack section
60 end rack piece
61 end rack piece
62 rack bridge piece
63 rack bridge piece
71 roofing
72 inner wall
73*a* top lining panel
73*b* side lining panel
73*c* bottom lining panel
74 window sill
75 knee wall
76*a* ceiling (second floor)
76*b* floor (attic)
77*a* ceiling (first floor)
77*b* floor (second floor)
78 inner wall (first floor)
79 inner wall (attic)
81 room (second floor)
82 attic
83 first floor room
84 roof void
90 internal equipment
100 ventilation assembly (top)
150 housing
151 cover
152 apertures for air intake
161 bottom section
161*a* entrance portion
161*b* shoulder portion
162 intermediate section
163 top section
1501 flow channel
1601 transition channel
1602 transition channel
1603 transition channel
1604 transition channel
170 filter rail
171 flange
172 lower guide
173 upper guide
180 filter holder
181 leg
182 opening
183 flange
184 filter element
200 second ventilation assembly (bottom)
201 duct
202 ceiling ventilation device

The invention claimed is:

1. A roof window system comprising:

a roof window having a frame including a frame top member, two side members and a bottom member, defining a frame plane, and a sash including a sash top member, sash side members and a bottom member, and a pane, the roof window further comprising at least one ventilation device adapted for providing ventilation of a building in which the roof window is mounted, at least one ventilation assembly including a housing accommodating at least one ventilation unit connected to an aperture for air intake and exhaust, transition means being provided between the at least one ventilation assembly and the sash top member of the roof window to accommodate a set of flow paths for air to and from the at least one ventilation assembly, said transition means comprise a plurality of apertures extending through the frame top member and a ventilation rack accommodated in the sash top member.

2. The roof window system according to claim 1, wherein the plurality of apertures extending through the frame top member are located mainly in a bottom half part of a height of the frame top member.

3. The roof window system according to claim 1, wherein the roof window system comprises internal equipment selected from a list comprising at least one of:

a top hinge device, electrical operator means, a covering assembly and a screening arrangement.

4. The roof window system according to claim 1, wherein the transition means are formed integrally in the housing of the ventilation assembly.

5. The roof window system according to claim 4, wherein the housing comprises a bottom section and an intermediate section, and wherein the transition means comprise a plurality of transition channels formed as an opening between a recessed entrance portion of a bottom section and an underside of an intermediate section.

6. The roof window system according to claim 5, wherein the bottom section and the intermediate section of the housing are made of an insulating material, the housing also including a top section of the same material.

7. A roof window system comprising:

a roof window having a frame including a frame top member, two side members and a bottom member, defining a frame plane, and a sash including a sash top member, sash side members and a bottom member, and a pane, the roof window further comprising at least one ventilation device adapted for providing ventilation of a building in which the roof window is mounted, at least one ventilation assembly including a housing accommodating at least one ventilation unit connected to an aperture for air intake and exhaust, transition means being provided between the at least one ventilation assembly and the sash top member of the roof window to accommodate a set of flow paths for air to and from the at least one ventilation assembly, said transition means comprise a plurality of apertures extending through the frame top member and a filter assembly including a filter rail connected to the housing of the ventilation assembly configured to receive a filter holder configured to be received in the plurality of apertures extending through the frame top member.

8. The roof window system according to claim 7, wherein the filter rail is releasably connected to the housing and is provided with guides forming a track configured to receive a leg of the filter holder.

9. The roof window system according to claim 1, wherein the ventilation rack has a modular configuration comprising a set of standardised rack sections including a plurality of rack sections dedicated to ventilation and including a respective aperture configured to form a fluid connection with the plurality of apertures extending through the frame top member.

10. The roof window system according to claim 9, wherein the set of standardised rack sections include an end rack piece, and a central rack section and a rack section with an aperture configured to receive locking means.

11. The roof window system according to claim 1, wherein the roof window comprises a frame gasket defining a first sealing plane and a sash gasket defining a second sealing plane, and wherein the sash gasket is received in a track in the ventilation rack.

12. The roof window system according to claim 11, wherein a plurality of brush seals are connected to the ventilation rack to form one or more closed chambers together with the frame gasket and the sash gasket, the flow paths of the transition means to the plurality of apertures extending through the frame top member being located within said one or more closed chambers.

13. The roof window system according to claim 10, wherein a first brush seal is connected to the central rack section, a second brush seal is connected to one end rack piece and a third brush seal is connected to another end rack piece.

14. The roof window system according to claim 13, wherein the transition means comprise four apertures extending through the frame top member and the ventilation rack includes four rack sections dedicated to ventilation, and wherein two of the respective apertures of the rack sections are located in each closed chamber formed by the respective brush seals, the frame gasket and the sash gasket.

15. The roof window system according to claim 1, wherein a second ventilation assembly is provided at the frame bottom member in addition to the at least one ventilation assembly provided at the frame top member of the roof window.

16. The roof window system according to claim 15, wherein the roof window is installed to provide ventilation in a room located upstairs in a multi-storey building, the at least one ventilation assembly provided at the frame top member being connected to the ventilation device of the roof window to ventilate to an upstairs room, and wherein the second ventilation assembly provided at the frame bottom member is installed to provide ventilation in at least one other room located downstairs relative to the room to which the at least one ventilation assembly ventilates.

17. The roof window system according to claim 16, wherein the second ventilation assembly is in fluid connection with the at least one other room by means of a duct and a second ventilation device.

18. The roof window system according to claim 15, wherein the second ventilation assembly is in fluid connection with the at least one ventilation assembly.

19. The roof window system according to claim 9, wherein the set of standardised rack sections include an end rack piece, and a central rack section and a rack section with an aperture configured to accommodate operating means of an electrical operator of the roof window system.

20. A roof window system comprising:

a roof window having a frame including a frame top member, two side members and a bottom member, defining a frame plane, and a sash including a sash top member, sash side members and a bottom member, and a pane, the roof window further comprising at least one ventilation device adapted for providing ventilation of a building in which the roof window is mounted, said frame top member including a top surface, a bottom surface, an outer side and an inner side, said outer side and said inner side each extending between said top surface and said bottom surface of said frame top member, at least one ventilation assembly including a housing accommodating at least one ventilation unit connected to an aperture for air intake and exhaust, transition means being provided between the at least one ventilation assembly and the sash top member of the roof window to accommodate a set of flow paths for air to and from the at least one ventilation assembly, said transition means comprise a plurality of apertures extending through the frame top member including said outer side of said frame top member.

* * * * *